US007328753B2

(12) United States Patent
Henriksson et al.

(10) Patent No.: US 7,328,753 B2
(45) Date of Patent: Feb. 12, 2008

(54) HYDRAULIC BREAKING HAMMER WITH LUBRICATED IMPLEMENT GUIDE SLEEVE

(75) Inventors: Stig Roland Henriksson, Nacka (SE); Anders Wilhelm Lundgren, Degerhamn (SE)

(73) Assignee: Atlas Copco Construction Tools AB, Nacka (SE)

( * ) Notice: Subject to any disclaimer, the term of this patent is extended or adjusted under 35 U.S.C. 154(b) by 0 days.

(21) Appl. No.: 11/519,694

(22) Filed: Sep. 12, 2006

(65) Prior Publication Data

US 2007/0068707 A1 Mar. 29, 2007

Related U.S. Application Data

(63) Continuation of application No. PCT/SE2005/000328, filed on Mar. 7, 2005.

(30) Foreign Application Priority Data

Mar. 12, 2004 (SE) ..... 0400615

(51) Int. Cl.
*E21B 10/00* (2006.01)

(52) U.S. Cl. ..... 173/9

(58) Field of Classification Search ..... 173/109, 173/114, 200, 128

See application file for complete search history.

(56) References Cited

U.S. PATENT DOCUMENTS 4,310,055 A * 1/1982 Wanner et al. ..... 173/118
5,002,136 A * 3/1991 Barthomeuf ..... 173/114
5,445,232 A 8/1995 Brannstrom et al.
5,873,579 A * 2/1999 Prokop et al. ..... 279/19
2001/0022227 A1* 9/2001 Deimel et al. ..... 173/128
2001/0043007 A1* 11/2001 Jang ..... 299/69
2003/0121725 A1 7/2003 Ilmarinen et al.
2005/0006105 A1* 1/2005 Bell et al. ..... 166/381
2006/0048957 A1* 3/2006 Oksman ..... 173/77

FOREIGN PATENT DOCUMENTS

DE 511574 C 10/1930
DE 19805187 A1 8/1999
EP 0525498 A2 2/1993
EP 1321245 A1 6/2003
GB 2 094 888 A 9/1982
GB 2122271 A 1/1984

* cited by examiner

*Primary Examiner*—Brian D. Nash
(74) *Attorney, Agent, or Firm*—Frishauf, Holtz, Goodman & Chick, P.C.

(57) ABSTRACT

A hydraulic breaker hammer includes a housing with a longitudinal bore, a cylinder sleeve, and a rear end cover engaging the cylinder sleeve. A hammer piston is reciprocally powered in the cylinder sleeve for delivering blows to a working implement inserted in a guide sleeve at the front end of the bore. The guide sleeve is provided with radial openings for communication of lubricant from a lubricant supply passage in the housing to the inside of the guide sleeve and the guide sleeve is provided with external seal rings forming annular compartments located between the lubricant supply passage and the radial openings for spreading lubricant on the outside surface of the guide sleeve.

3 Claims, 2 Drawing Sheets

HYDRAULIC BREAKING HAMMER WITH LUBRICATED IMPLEMENT GUIDE SLEEVE

CROSS-REFERENCE TO RELATED APPLICATIONS

This application is a Continuation of International Application PCT/SE2005/000328 filed Mar. 7, 2005, based on SE 0400615-1 filed Mar. 12, 2004, the entire contents of which are incorporated herein by reference.

FIELD OF THE INVENTION

The invention relates to a hydraulic breaking hammer of the type having a housing with a longitudinal bore, a hammer piston reciprocally powered in the bore, a guide sleeve for receiving a working implement, and a lubricant supply passage in the housing communicating with radial openings in the guide sleeve for communicating lubricant to the inside of the guide sleeve.

BACKGROUND OF THE INVENTION

In prior art hydraulic breaker hammers of this type, see for instance U.S. Pat. No. 5,445,232, it is well known to supply lubricant grease to the inside of the working implement sleeve, but there is also a problem with the guide sleeves being seized in the housing. This means that after some operation time there is a tendency that the guide sleeve gets seized in the housing bore due to frictional action under vibration movement of the guide sleeve. This results in difficulties when removing the guide sleeve from the housing for service, replacement etc. Costly time and effort have to be spent just to remove the guide sleeve from the housing, which is most undesirable.

SUMMARY OF THE INVENTION

The main object of the invention is to create a breaking hammer of the above described type wherein the guide sleeve is prevented from getting seized in the housing bore such that removal of the guide sleeve from housing bore is facilitated.

Further object and advantages of the invention will appear from the following specification and claims.

BRIEF DESCRIPTION OF THE DRAWINGS

A preferred embodiment of the invention is described below with reference to the accompanying drawing.

DETAILED DESCRIPTION

Figure 1:
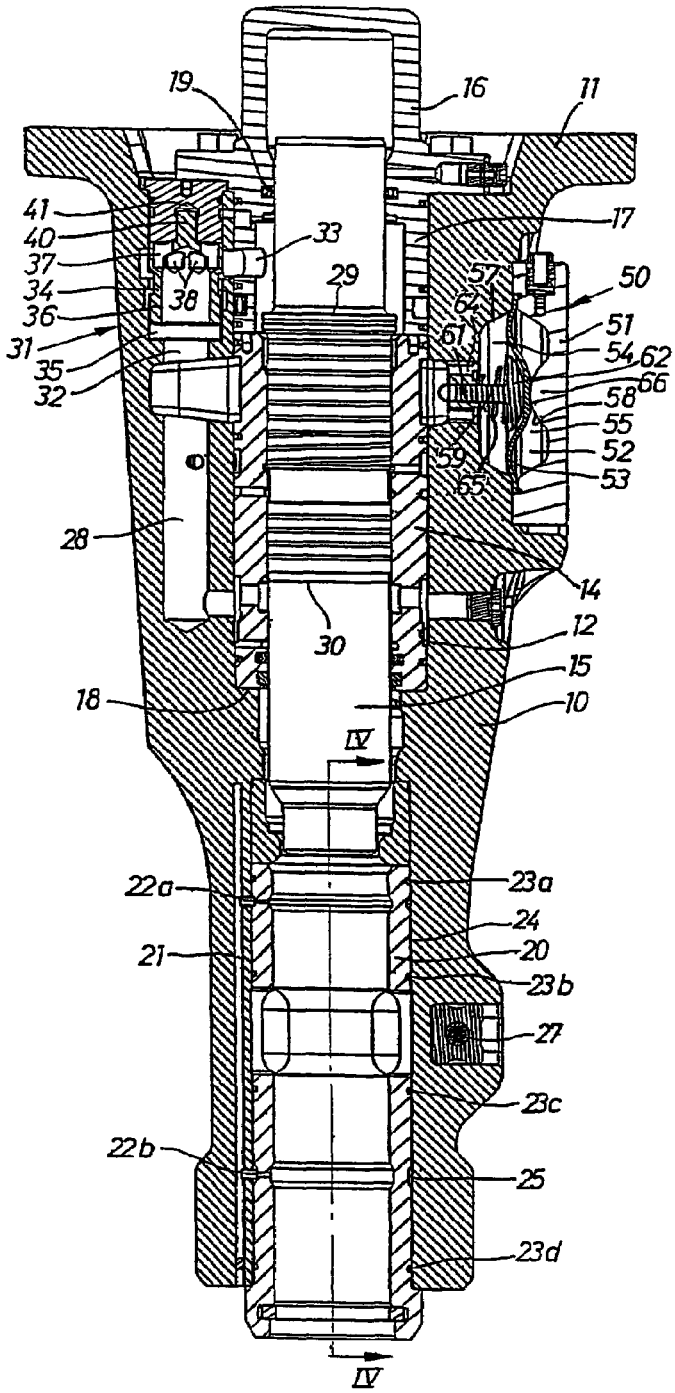
FIG. 1 shows a longitudinal section through a hydraulic breaking hammer according to the invention.
Figure 2:
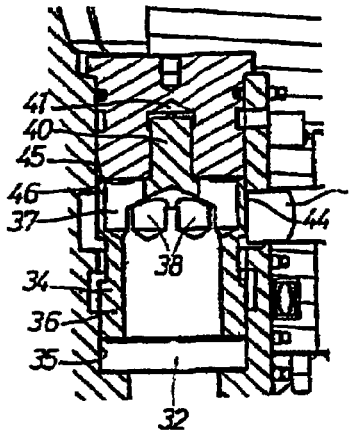
FIG. 2 shows on a larger scale a section through the distribution valve of the breaking hammer in FIG. 1.

The hydraulic breaking hammer illustrated in the drawing figures comprises a housing 10 formed with a rear mounting shoulder 11 for attachment to a mechanical carrier like an excavator arm. The housing 10 is provided with a longitudinal through bore 12 which in its rear part supports a cylinder sleeve 14 for sealingly guiding a hammer piston 15. At the rear end of the housing 10 an end cover 16, which forms an end closure for the bore 12, is bolted on. This end cover 16 is formed as a one piece member with a tube shaped neck portion 17 which extends into the bore 12 and contacts the rear end of the cylinder sleeve 14. The latter is clamped in its proper position in the bore 12 between the end cover neck portion 17 and a shoulder 18 in the bore 12. The neck portion 17 also forms a guide means for the hammer piston 15 and carries a seal ring 19 for co-operation with the rear end of the hammer piston 15.

Figure 3:
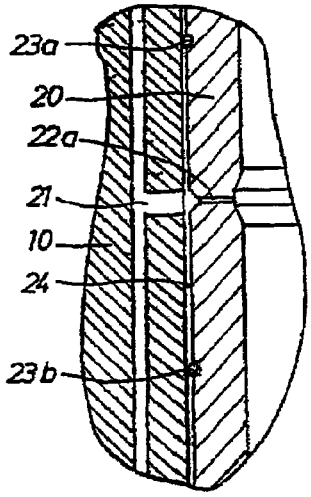
FIG. 3 shows on a larger scale a fractional section through the implement sleeve arrangement of the breaking hammer in FIG. 1.
Figure 4:
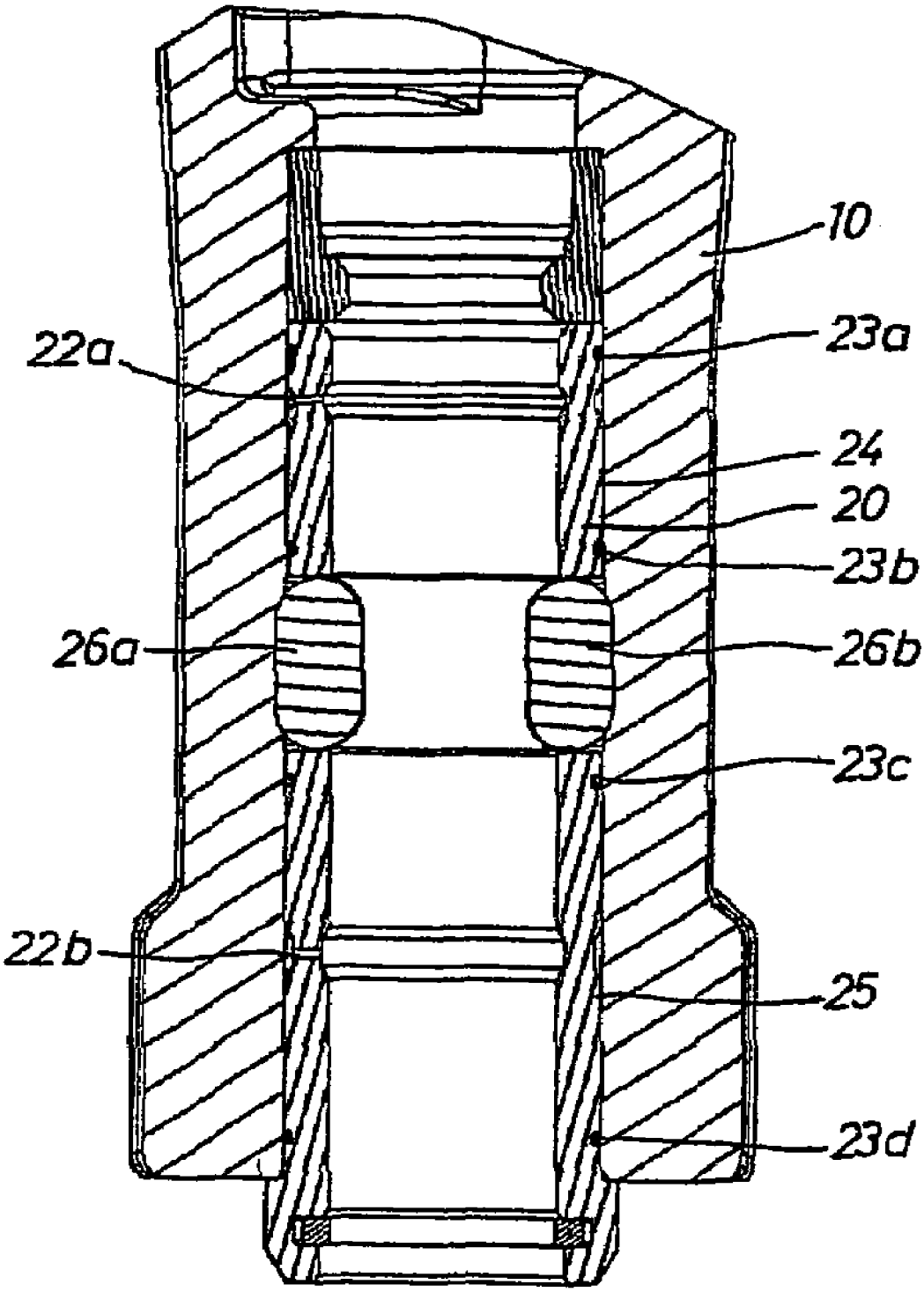
FIG. 4 shows a longitudinal section along line IV-IV in FIG. 1.

In its front part the bore 12 carries a working implement guide sleeve 20 which is intended to receive the rear end of a working implement (not shown). The working implement as well as the guide sleeve 20 are axially retained relative to the housing 10 by means of two lock bars 26*a,b* which extend perpendicularly to the guide sleeve 20 and which are kept in place by a transverse dowel 27. See FIGS. 1 and 4. For lubricating the sleeve 20 on its inside there is provided a lubricant supply passage 21 in the housing 10 which via radial openings 22 *a,b* in the guide sleeve 20 communicates with the inside of the guide sleeve 20. Moreover, the guide sleeve 20 is provided with four O-rings 23*a-d* on its outside the purpose of which is to seal off between them two annular compartments 24,25 located at opposite sides of the lock bars 26*a,b*. The radial openings 22*a,b* in the guide sleeve 20 are located between the O-rings 23*a,b* and 23*c,d*, respectively, such that lubricant has to pass through the compartments 24,25 to reach the radial openings 22*a,b* and the guide sleeve 20 inside. See FIG. 3. Accordingly, the compartments 24,25 are filled with lubricant (grease), and due to the relative axial extension of the compartments 24,25 lubricant is spread over a substantial part of the outside surface of the guide sleeve 20, thereby, preventing seizure of the guide sleeve 20 relative to the bore 12.

The guide sleeve 20 is in fact non-reciprocating during tool operation, but due to the influence of impact related pressure waves transferred via the lock bars 26*a, b* there are small local vibrational movements in the guide sleeve 20, which tend to cause a sort of friction welding between the guide sleeve 20 and the housing 10. Without a proper lubrication this will cause a seizure of the guide sleeve 20 in the housing 10, which results in a difficult problem to remove the guide sleeve 20 from the housing 10 at service operations.

The housing 10 has a pressure fluid inlet passage 28 for supplying motive pressure fluid to the cylinder sleeve 14 so as to drive the hammer piston 15 in its reciprocating movement for delivering blows to a working implement inserted in the guide sleeve 20. The piston 15 has two oppositely facing drive surfaces 29,30, whereof the lower surface 30 is continuously connected to the pressure fluid source, whereas the upper surface 29 is intermittently pressurised via a pressure fluid distribution valve 31. The distribution valve 31 has a fluid inlet 32 communicating with the pressure fluid inlet passage 28, and a fluid outlet 33 communicating with the upper drive surface 29 of the hammer piston 15. Moreover, the distribution valve 31 comprises a valve bore 35 and a valve element 34 sealingly guided in the bore 35. The valve element 34 consists of a tubular guide portion 36 guided in the bore 35, and an end wall 37. In the end wall 37 there are through openings 38 for connecting the inside of the guide portion 36 and the fluid inlet 32 with the outer surface of the end wall 37. The end wall 37 is provided with a reduced diameter activation portion 40 which extends co-axially in a direction opposite the guide portion 36 and is received in an intermittently pressurised activation bore 41.

The end wall 37 has a slightly larger cross section than the guide portion 36, and since the valve element 34 is open ended the fluid pressure will act constantly both on the surface area formed by the guide portion 36 and via the openings 38 on the outer surface of the end wall 37. In the position where the activation bore 41 is connected to tank, i.e. no pressure acting on the activation portion 40, the remaining part of the end wall 37 is smaller than the guide portion area resulting in a closing force on the valve element 34. When instead the activation bore 41 is pressurised the total area of the end wall plus activation portion 40 will generate a force that will dominate over the force generated by the pressure acting on the guide portion area. This means that the valve element 34 is shifted to its open position. (Not shown).

The valve element 34 is provided to control the communication between the inlet 32 and the outlet 33, and for that purpose the valve element 34 is formed with a double seal function, namely both a clearance seal and a seat seal. The clearance seal function is obtained by a circumferential surface 44 of the end wall 37 co-operates with the valve bore 35 as illustrated in the closed position of the valve shown in FIG. 1. The seat seal is accomplished by an annular seat 45 at the end of the bore 35 in co-operation with an annular contact surface 46 on the end wall 37. By a combined clearance seal and seat seal as described above there is obtained a high degree of valve tightness and, hence, a high efficiency of the hammer.

The breaker hammer shown in the drawing also comprises a pressure peak absorbing accumulator 50 which is partly formed by the hammer housing 10 and partly by a cover 51 attached to the housing 10. The accumulator 50 comprises an expansion chamber 52 which in a conventional way is divided by a flexible membrane 53 into a pressure fluid compartment 54 and a gas cushion compartment 55. The expansion chamber 52 is defined by an inner wall 57 and an outer wall 58, wherein the outer wall 58 is formed by the cover 51.

There is also provided a movable membrane support 59 consisting of a stem portion 61 and a membrane engaging head 62. The latter is located inside the pressure fluid compartment 54, whereas the stem portion 61 is displacebly guided in a bore in the inner wall 57. Openings 64 are provided in parallel with the stem portion 61 to communicate pressure fluid into the expansion chamber 52, and the head 62 of the membrane support 59 is arranged to cover these openings 64 at low pressure levels when the membrane 53 is pressed against the inner wall 57. A spring 65 is provided to exert a bias force on the membrane support 59 in the direction of the membrane 53. In order to limit the length of the guiding stem portion 61 there is provided a stop means in the form of a bulge shaped projection 66 on the outer expansion chamber wall 58. This projection 66 is formed integrally as a one piece member with the cover 51. This movement limiting arrangement for the membrane support 59 is simple in design as it contain no extra elements.

The guide sleeve lubricating arrangement according to the invention means an improved and facilitated handling of the guide sleeve at service and replacement. However the embodiments of the invention are not limited to the described example but can be freely varied within the scope of the claims.

The invention claimed is:

1. A hydraulic breaking hammer, comprising:

a housing with a longitudinal bore;

a hammer piston reciprocally guided in the bore;

a working implement receiving guide sleeve, for receiving a working implement, provided in a front part of the bore;

a retaining mechanism arranged to axially lock, with respect to an axial direction of the longitudinal bore of the housing, the working implement and the guide sleeve; and a lubricant supply passage, provided in the housing, communicating with an inside of the guide sleeve via at least one radial opening in the guide sleeve;

wherein an outside of the guide sleeve is provided with at least two circumferentially extending seal rings which are axially spaced apart from each other along the axial direction of the longitudinal bore to form between them at least one annular compartment having an axial extent along the axial direction that is determined by a distance between the seal rings along the axial direction; and wherein said at least one annular compartment is arranged to communicate both with the lubricant supply passage and with said at least one radial opening in the guide sleeve, such that a lubricant is supplied from the lubricant supply passage to the inside of the guide sleeve via said at least one annular compartment and said at least one radial opening, whereby the lubricant is spread over a part of an outside surface of the guide sleeve defined by the axial extent of said at least one annular compartment.

2. The hydraulic breaking hammer according to claim 1, wherein said seal rings are four in number, and wherein two separate said annular compartments are provided at opposite sides of the retaining mechanism.

3. A hydraulic breaking hammer, comprising:

a housing with a longitudinal bore;

a hammer piston reciprocally guided in the bore;

a working implement receiving guide sleeve, for receiving a working implement, provided in a front part of the bore;

a retaining mechanism arranged to axially lock, with respect to an axial direction of the longitudinal bore of the housing, the working implement and the guide sleeve; and a lubricant supply passage, provided in the housing, communicating with an inside of the guide sleeve via two radial openings in the guide sleeve;

wherein an outside of the guide sleeve is provided with four circumferentially extending seal rings which are axially spaced apart from each other along the axial direction of the longitudinal bore, such that a first pair of the seal rings forms a first annular compartment having an axial extent along the axial direction that is determined by a distance between the seal rings of the first pair along the axial direction, and such that a second pair of the seal rings forms a second annular compartment having an axial extent along the axial direction that is determined by a distance between the seal rings of the second pair along the axial direction, said first and second annular compartments being provided on opposite sides of the retaining mechanism; and wherein each of the annular compartments is arranged to communicate both with the lubricant supply passage and with one of the radial openings in the guide sleeve, such that a lubricant is supplied from the lubricant supply passage to the inside of the guide sleeve via the annular compartments and the radial openings, whereby the lubricant is spread over a part of an outside surface of the guide sleeve defined by the axial extents of the annular compartments.

* * * * *